US006233902B1

(12) United States Patent
Nakagawa

(10) Patent No.: US 6,233,902 B1
(45) Date of Patent: May 22, 2001

(54) PACKAGING MACHINE

(75) Inventor: Yukio Nakagawa, Shiga (JP)

(73) Assignee: Ishida Co., Ltd., Kyoto (JP)

( * ) Notice: Subject to any disclaimer, the term of this patent is extended or adjusted under 35 U.S.C. 154(b) by 0 days.

(21) Appl. No.: 09/353,180

(22) Filed: Jul. 14, 1999

(30) Foreign Application Priority Data

Jul. 22, 1998 (JP) ..... 10-206451

(51) Int. Cl.[7] ..... B65B 9/20; B65B 57/00

(52) U.S. Cl. ..... 53/55; 53/74; 53/502; 53/551

(58) Field of Search ..... 53/55, 74, 502, 53/551, 552

(56) References Cited

U.S. PATENT DOCUMENTS 3,397,505 * 8/1968 Critchell ..... 53/74
4,018,029 * 4/1977 Safranski et al. ..... 53/502
4,023,327 * 5/1977 Simmons ..... 53/552
4,128,985 * 12/1978 Simmons ..... 53/502
4,597,240 * 7/1986 Scully ..... 53/552
5,743,066 * 4/1998 Fukuda et al. ..... 53/551

FOREIGN PATENT DOCUMENTS 0449551 3/1991 (EP) .

* cited by examiner

*Primary Examiner*—John Sipos
(74) *Attorney, Agent, or Firm*—Coudert Brothers

(57) ABSTRACT

A form-fill-seal packaging machine has a pull-down mechanism for advancing an elongated bag-making film, a longitudinal sealer for sealing the film in the longitudinal direction to make a tube and a transverse sealer for sealing the film transversely to form the bottoms and the tops of the bags, and is controlled such that the longitudinal sealer is activated for a specified length of time whenever a ready signal is outputted to the weigher to request a discharge of articles to be packaged but the operations of the pull-down mechanism and the transverse sealer are not started unless a signal is received from the weigher, indicating that it has discharged articles as requested.

8 Claims, 7 Drawing Sheets

PACKAGING MACHINE

BACKGROUND OF THE INVENTION

This invention relates to a form-fill-seal packaging machine. More particularly, this invention relates to a control device for the longitudinal sealer of such a packaging machine.

Such a packaging machine of the so-called vertical pillow type transports an elongated thermoplastic bag-making material (the "film") along the outer surface of a filling cylinder while bending it into a tubular form by means of a former and to seal the mutually overlapping side edges of the film by means of a longitudinal sealer and simultaneously both the top edge of the bag which has been filled and the bottom edge of the next bag to be filled by means of a transverse sealer. For the longitudinal sealing, a sealer employing a heat belt is commonly used.

A packaging machine of this type is usually operated without stopping except in the case of a trouble, transporting the film continuously. In the case of a packaging machine of the type forming a system with a weigher, the packaging machine serving as the "main" and the weigher serving as the "slave" such that the weigher will serve to supply articles to be packaged in response to a "ready" signal outputted from the packaging machine, the packaging machine may be designed to stop the transport of the film temporarily when no articles are supplied from the weigher for whatever reason and to remove the heater belt so as to separate it from the film. If no articles are supplied in the next cycle, however, the heater belt will heat the same portions of the film in preparation for the next packaging operation, thereby damaging the film and producing a defective bag.

If the mechanism for transporting the film and the heater belt are controlled so as to be activated together, however, the longitudinal sealing will not be effected sufficiently on the beginning portion of the film, again producing a defective bag which can easily break after transversely sealed.

SUMMARY OF THE INVENTION

It is therefore an object of this invention, in view of the problems described above, to provide an improved packaging machine which will not produce any defective package even when it is reactivated after the supply of articles is once stopped and then restarted.

A packaging machine embodying this invention, with which the above and other objects can be accomplished, may be characterized as having a control unit adapted to control the operations of the packaging machine as a whole such that the longitudinal sealer is operated for a specified period of time when a first ready signal is outputted to the weigher and the mechanism for the film transport and the transverse sealers are activated after waiting until a signal is received from the weigher, indicating that a discharge of articles has been completed. With a packaging machine thus structured, longitudinal sealing is carried out for a specified length of time required for the type of film being used when a ready signal is outputted to the weigher to request a discharge of articles to be packaged, but the operations of the mechanisms for advancing the film and transverse sealing are started only after a signal is received from the weigher, indicating that the requested discharge of articles has been carried out.

The invention provides packaging machines with the advantage that properly sealed bags can be produced even after the weigher failed to discharge articles to be packaged.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

DETAILED DESCRIPTION OF THE INVENTION

Figure 1:
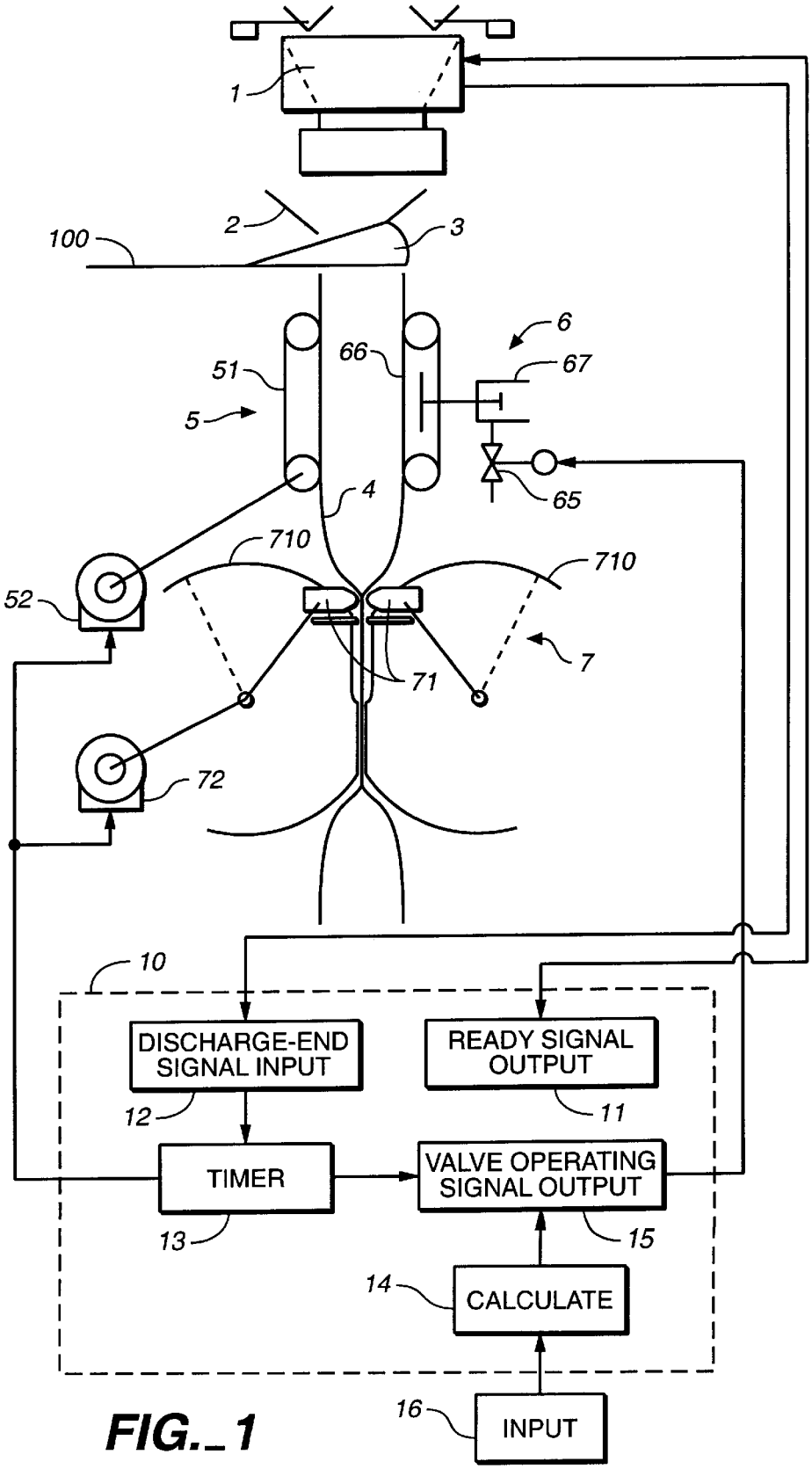
FIG. 1 is a schematic presentation of a packaging machine embodying this invention with a portion shown as a block diagram.

The invention is described next by way of an example. In FIG. 1, numeral 1 indicates a weigher such as a combinational weigher with a large number of weighing heads. A hopper 2 for receiving articles weighed by and discharged from the weigher 1 is disposed therebelow, and a former 3 for bending an incoming film 100 into a tubular form and a pull-down mechanism 5 for transporting the tubularly formed film 100 to a transverse sealer 7. A longitudinal sealer 6 for longitudinally sealing together the mutually overlapping side edges of the tubularly formed film 100 is disposed below the hopper 2.

Figure 2:
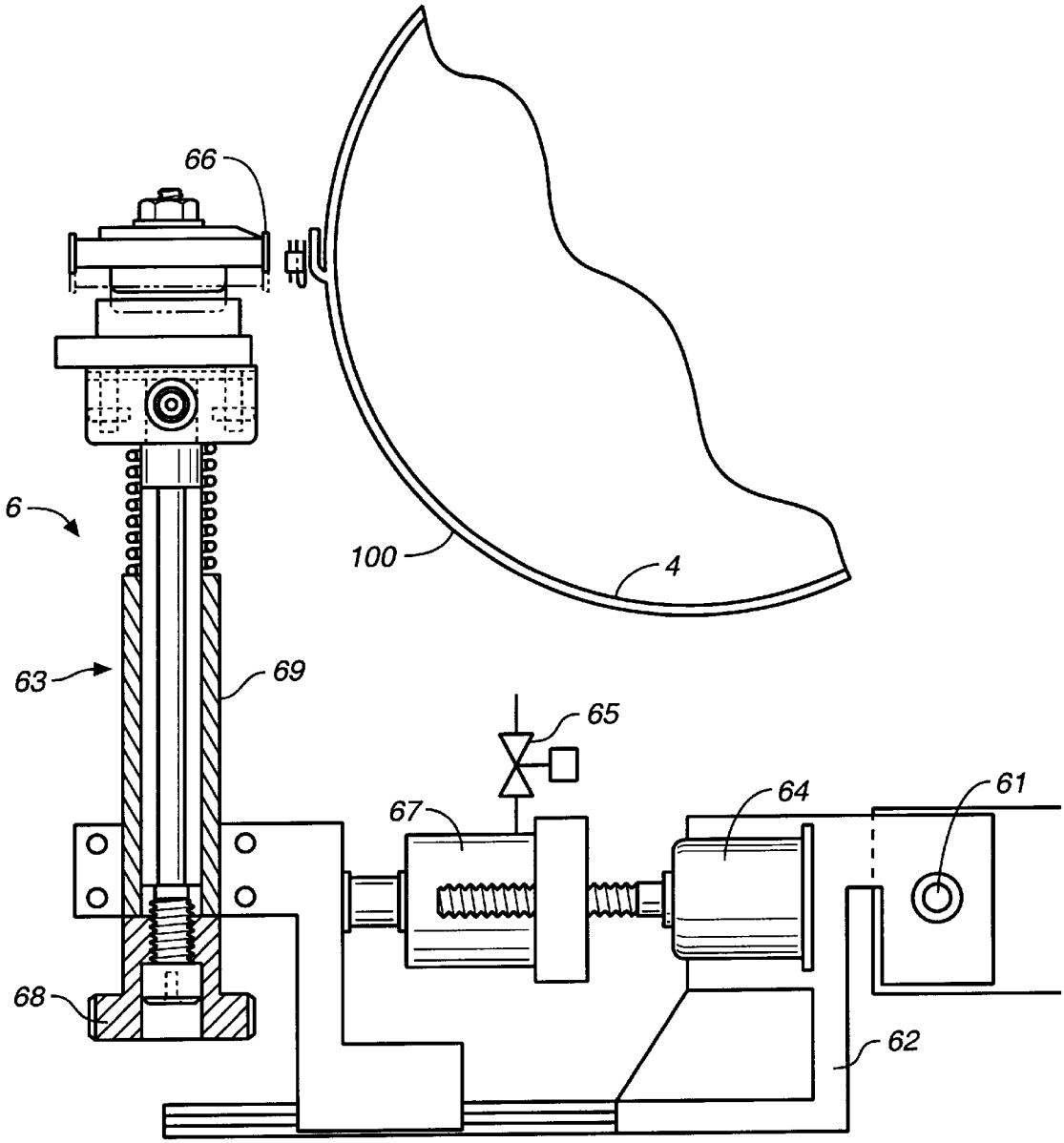
FIG. 2 (PRIOR ART)
FIG. 2 is a partially sectional plan view of the longitudinal sealer of FIG. 1.

FIG. 2 shows more in detail the longitudinal sealer 6, as disclosed by the present inventor in Japanese Patent Publication Tokkai 6-239318. The longitudinal sealer 6 is disposed, like pull-down belts 51 for pulling the film 100 downward, proximally to a filling cylinder 4 through which articles to be packaged are dropped from the hopper 2 and includes a longitudinal sealer unit 63 which can be moved away from the filling cylinder 4 by means of a swing arm 62 rotatable around a support pin 61 when, for example, the filling cylinder 4 is exchanged. It also includes a positioning motor 64 for positioning a longitudinal seal belt 66 at an appropriate position according to the diameter of the filling cylinder 4 and an air cylinder 67 which operates by means of an electromagnetic valve 65 to release the compressive pressure by the seal belt 66 from the surface of the film 100 when the operation of the packaging machine has been stopped. In FIG. 2, numeral 68 indicates a knob for changing the seal position and numeral 69 indicates a sleeve for changing the angle of the seal belt 66 at which the film 100 is contacted.

In FIG. 1, numeral 10 indicates a control circuit forming a part of a host computer adapted to control the packaging machine as a whole, or the entire package-making system inclusive of the weigher 1. As schematically shown in FIG. 1, the control circuit 10 includes ready signal outputting means 11, discharge-end signal inputting means 12, a timer 13, calculating means 14, and valve operating signal outputting means 15. The ready signal outputting means 11 is for outputting a ready signal to the weigher 1, when the user presses a ready button (not shown), to indicate that the packaging machine is ready to receive articles to be packaged, thereby causing the weigher 1 to discharge a weighed batch of articles. The discharge-end signal inputting means 12 is for receiving a discharge-end signal which is outputted by the weigher 1 when it finishes discharging a batch of articles to the packaging machine and responding to it by outputting a signal to the timer 13. The timer 13 is for counting a specified delay time T1 (to be explained below) from the moment when it receives the signal from the discharge-end signal inputting means 12 and then outputting a start signal to a pull-down motor 52 of the pull-down mechanism 5 and an arm-driving motor 72 of the transverse sealer 7. The calculating means 14 is for subtracting time length T2 (the "longitudinal seal time") required for the longitudinal sealing from the aforementioned delay time T1, when an operation-starting switch (not shown) is pressed, and transmitting a signal indicative of the result of this calculation to the valve operating signal outputting means 15. The valve operating signal outputting means 15 serves to output an operating signal to the electromagnetic valve 65 in the beginning in response to an output signal from the calculating means 14 and later in response to a signal from the timer 13. An input device 16 through which the longitudinal seal time T2 is inputted to the calculating means 14 for each selected kind of film 100 may also be considered a part of the control circuit.

Figure 3:
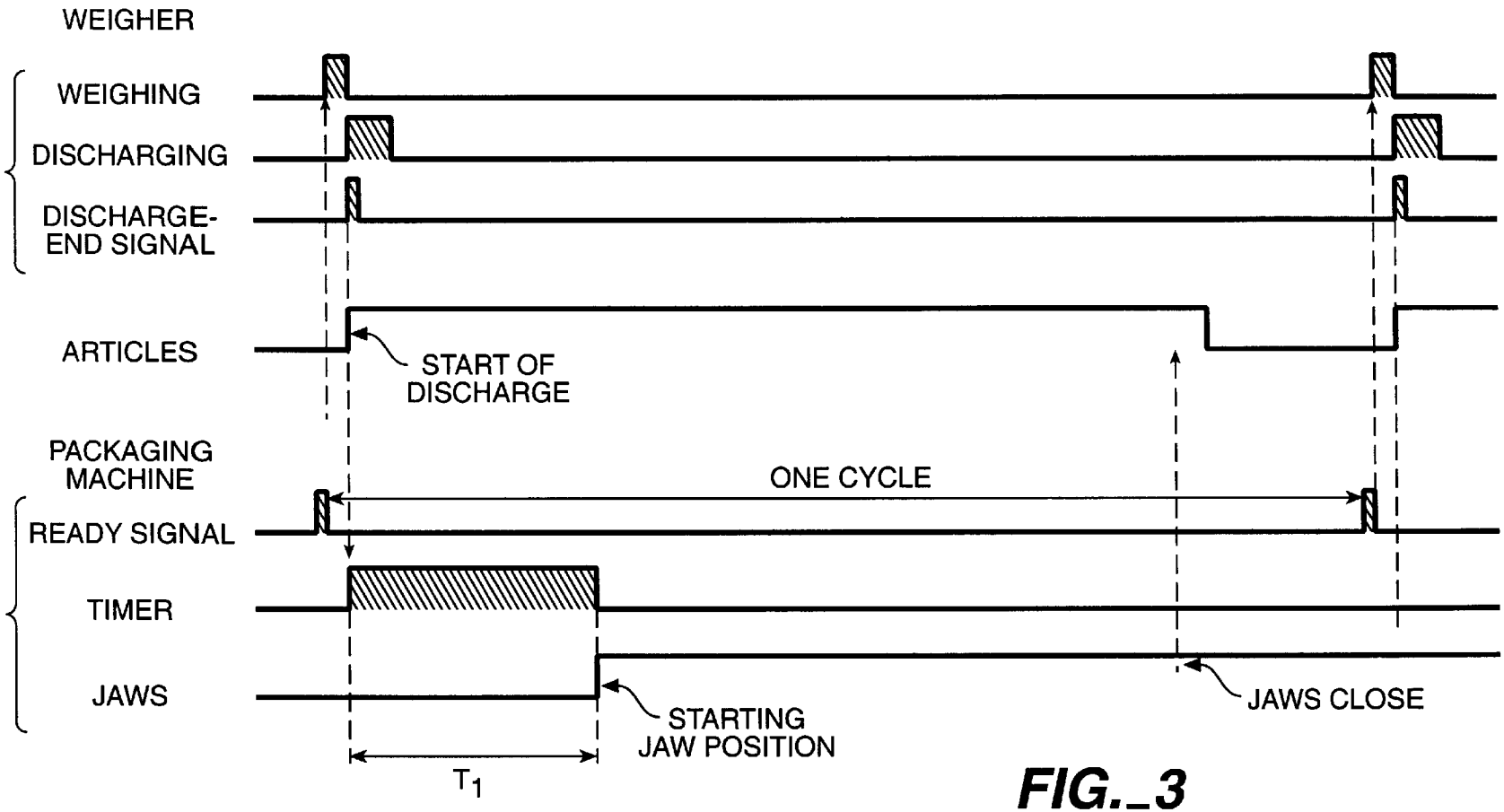
FIG. 3 is a timing chart for explaining the delay time in the operation of the packaging machine.

The aforementioned delay time T1 will be explained next with reference to FIG. 3 which is a timing chart for the operation of the seal jaws 71 with respect to the other components. Detailed accounts of how a transverse sealer of the type shown at 7 in FIG. 1 have been available, say, in U.S. Pat. No. 5,753,066, and hence will not be repeated here. When the weigher 1 starts to discharge a batch of articles in response to a ready signal from the packaging machine, the motion of the seal jaws 71, which are waiting at their specified starting positions 710, is started with this delay time T1 such that the seal jaws 71 come to engage each other with the film 100 in between when the dropped articles have passed the position of the engagement of the seal jaws 71. In other words, the delay time T1 is determined by the speed of motion of the seal jaws 71. As explained above, the downward motion of the film 100 by the pull-down belts 51 is also started after this delay time T1. The longitudinal seal time T2, on the other hand, is dependent on the kind of the film 100 and is determined such that the longitudinal sealing can be accomplished securely and dependably over the entire distance between the pulleys for the seal belt 66.

The operation of the packaging machine structured as described above will be explained next with reference to FIG. 4 as well as FIG. 3. The longitudinal seal time T2, dependent on the type of the film 100 as explained above, is preliminarily inputted to the calculating means 14 through the input device 16. When the operating switch (not shown) is pressed thereafter, a ready signal is transmitted (at time $t_a$) from the ready signal outputting means 11 of the packaging machine to the weigher 1, requesting that articles for packaging be discharged. At the same time, the calculating means 14 subtracts the inputted longitudinal seal time T2 from the delay time T1. Let us assume now that the weigher 1 did not output any discharge-end signal for a specified length of time T3 after the output of the ready signal (at time $t_a$). At time $t_b$ after time period T1–T2 has farther elapsed, the electromagnetic valve 65 is activated by a signal outputted from the valve operating signal outputting means 15 so as to operate the air cylinder 67, causing the longitudinal seal belt 66 to be pressed onto the mutually overlapping side edges of the film 100 for the inputted seal time T2 and thereby carrying out the longitudinal sealing.

If no discharge-end signal from the weigher 1 is received by the discharge-end signal inputting means 12 although the ready signal has been transmitted, the timer 13 is not allowed to start operating and hence the pull-down mechanism 5 and the transverse sealer 7 remain inactive.

Figure 4:
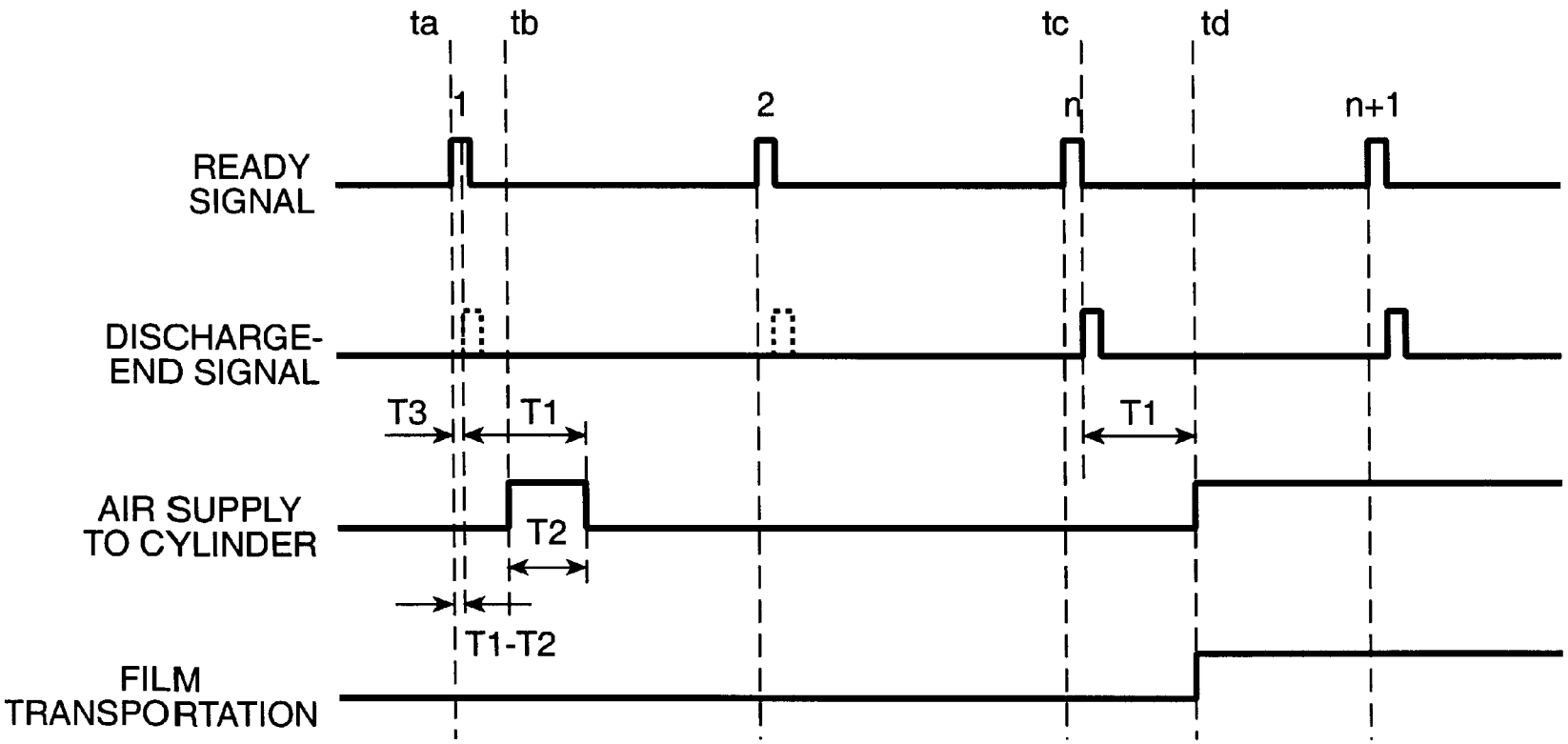
FIG. 4 is a timing chart for the operation of a packaging machine of this invention.

FIG. 4 shows a situation where the weigher 1 still fails to output a discharge-end signal in response to the second ready signal transmitted from the ready signal outputting means 11 of the packaging machine to the weigher 1 after a period for one cycle has elapsed (that is, in the second cycle, indicated by numeral "2" in FIG. 4). If a discharge-end signal is received only at time $t_c$ in the nth cycle (indicated by letter "n" in FIG. 4), the timer 13 begins to count time, as shown in FIG. 3 and after a time period equal to the delay time T1 has been counted, or at time td, the electromagnetic valve 65 and the motors 52 and 72 are activated such that air begins to be supplied to the air cylinder 67, the pull-down belts 51 begin to pull the film 100 downward and the seal jaws 71 of the transverse sealer 7 begin their motion. Since the tubularly formed film 100 is already sealed longitudinally during the first cycle of operations, the making of a bag is thus completed and the bag is discharged as a finished product. Let us now assume that the weigher 1 does not fail to output a discharge-end signal in response to a ready signal in the (n+1)st cycle and thereafter. The electromagnetic valve 65 and the motors 52 and 72 for the pull-down mechanism 5 and the transverse sealer 7 will go into a continuous mode of operations to operate the longitudinal seal belt 66, the pull-down belts 51 and the seal jaws 71, respectively.

Figure 5:
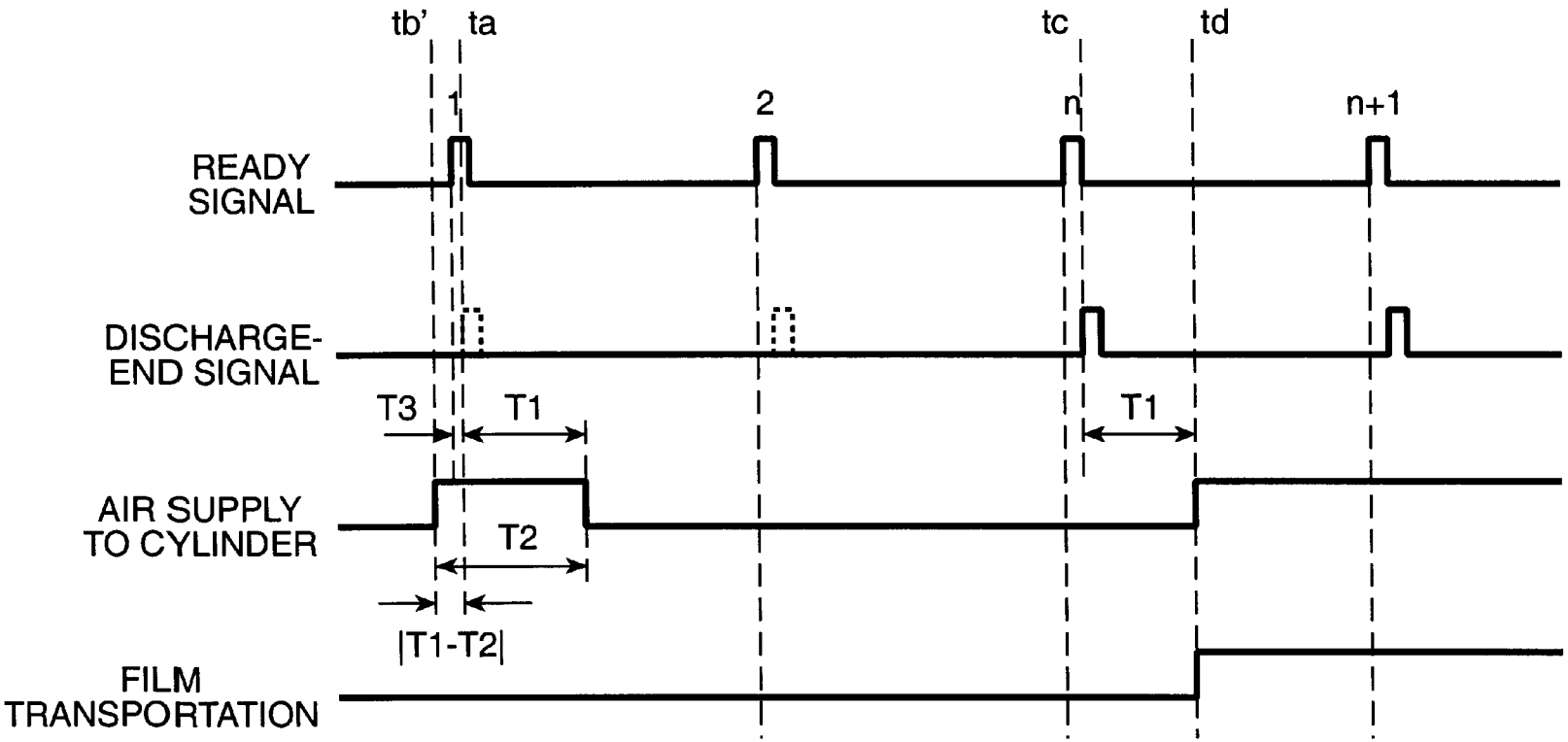
FIG. 5 is another timing chart for the operation of a packaging machine of this invention with a different type of film.

FIG. 5 shows a timing chart for the operation when the type of the film 100 is such that the required longitudinal seal time T2 is longer than the delay time T1. When the operation-starting switch (not shown) is pressed in such a case, the valve operating signal outputting means 15 activates the electromagnetic valve 65 at time $t_b'$ earlier by |T1–T2| (or T2–T1) than the time by which the aforementioned specified time period T3 has elapsed since a ready signal was outputted. Other than that, the timing chart in this case is the same as shown in FIG. 4.

Only situations wherein the weigher 1 fails to output a discharge-end signal in response to the ready signal in the first cycle of its operation have been described above. Let us now consider situations wherein the weigher 1 does not fail to output a discharge-end signal in the first cycle of its operation in response to a ready signal. In such a situation, the timer 13 is started before or after the electromagnetic valve 65 is activated, as shown in FIGS. 6 and 7, respectively, depending on whether the longitudinal seal time T2 is shorter or longer than the delay time T1, and the operations of the pull-down mechanism 5 and the transverse sealer 7 are started after the elapse of the delay time T1.

Figure 6:
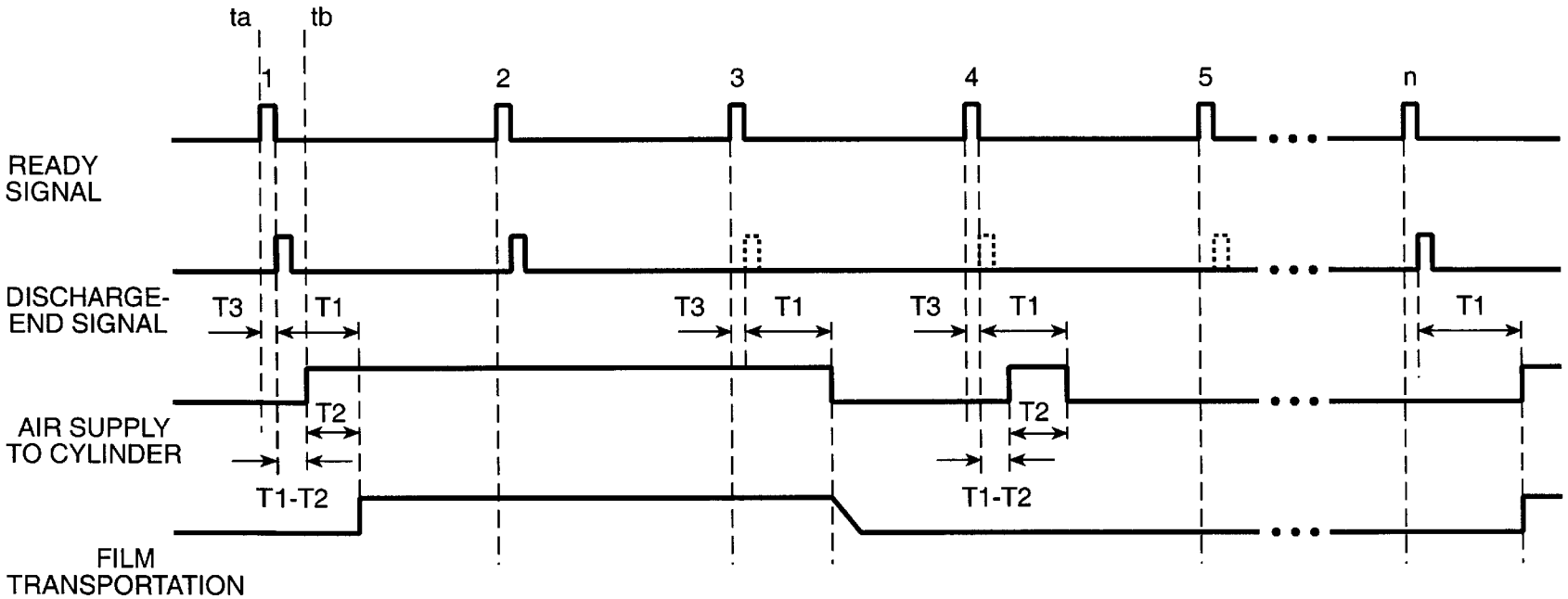
FIGS. 6 and 7 are still other timing charts for the operation of a packaging machine of this invention under different situations.
Figure 7:
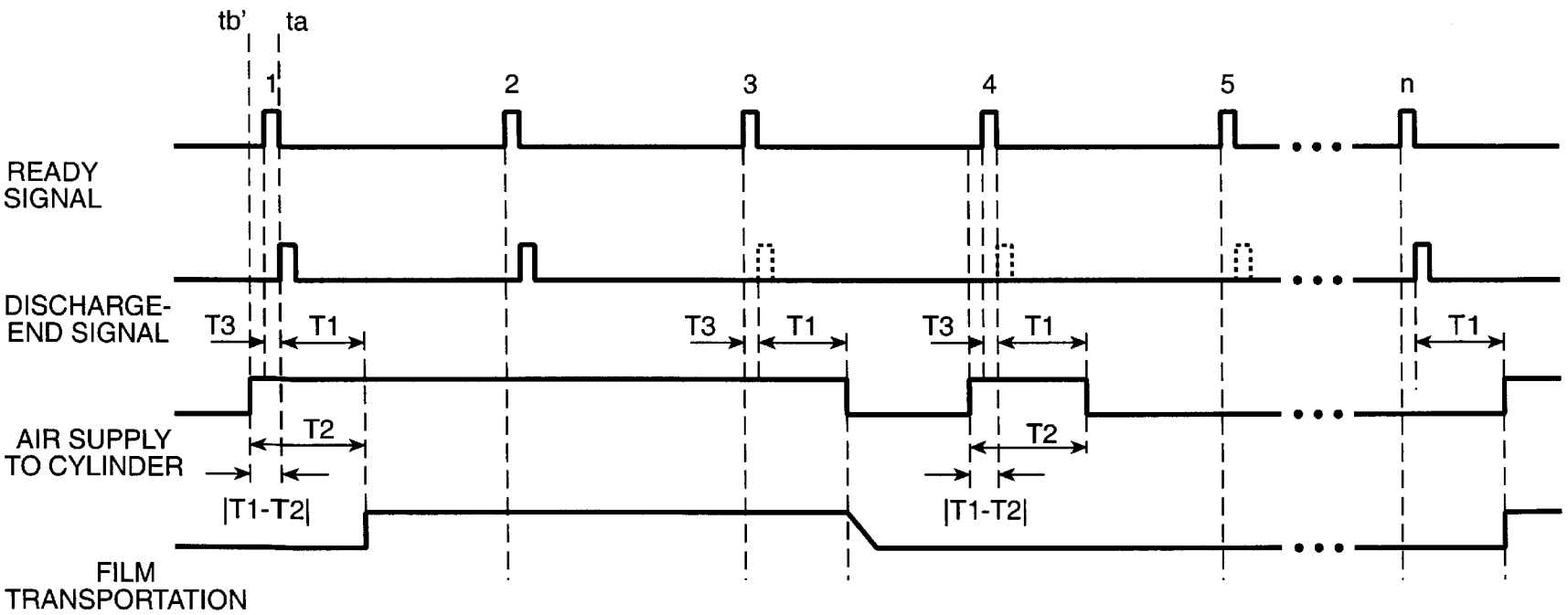

FIGS. 6 and 7 show situations wherein the weigher 1 continues not to fail to output a discharge-end signal in response to the ready signal but does fail to do so in the third cycle of its operation. As the discharge-end signal is outputted in the second cycle, FIGS. 6 and 7 show that the electromagnetic valve 65 and the pull-down and arm-driving motors 52 and 72 of the pull-down mechanism 5 and the transverse sealer 7 operate the longitudinal seal belt 66, the pull-down belts 51 and the seal jaws 71 in a continuous mode of packaging operations. In the third cycle, however, as the weigher 1 fails to output a discharge-end signal even after waiting for the specified wait period of T3 after the ready signal is outputted, the electromagnetic valve 65 is deactivated to remove the longitudinal seal belt 66 from the overlapping edge portions of the film 100, the arm-driving motor 72 is stopped such that the seal jaws 71 will rest at their starting positions 710, and the pull-down motor 52 is decelerated and stopped such that the upper end of the longitudinally sealed portion of the film 100 will come to a position somewhat above the lower end position of the seal belt 66 and stop after the delay time T1 has further elapsed. By this time, the articles which were discharged in response to the ready signals in the first and second cycles are already packaged.

The operations in the fourth and subsequent cycles are the same as explained above with reference to FIGS. 4 and 5. In FIGS. 4, 5, 6 and 7, ready signals are outputted automatically and periodically to the weigher 1 from the second cycle onward.

Although not separately illustrated, it goes without saying that the present invention is applicable to packaging machines adapted to be operated in the so-called intermittent mode of film transportation in which the film is transported not in a continuous manner but in an intermittent manner.

What is claimed is:

1. A packaging machine operating in combination with a weigher, said packaging machine comprising:

film transporting means for transporting an elongated bag-making film in a longitudinal direction while bending said film into a tubular form;

a longitudinal sealer for sealing edges of said tubularly formed film in said longitudinal direction;

a transverse sealer for sealing said longitudinally sealed film in a transverse direction which is transverse to said longitudinal direction; and a control means for operating said longitudinal sealer for a specified seal time period when a ready signal is outputted from said control means to said weigher to request a discharge of articles and starting operations of said film transporting means and said transverse sealer only after a discharge-end signal indicative of the discharge of articles from said weigher is received from said weigher in response to said ready signal.

2. The packaging machine of claim 1 wherein said control means starts operation of said longitudinal sealer after a wait period of T1–T2 has elapsed after said ready signal is outputted, where T1 represents a delay period from when said discharge-end signal is received until when said transverse sealer is activated and T2 represents said seal time period, if T1 is longer than T2.

3. The packaging machine of claim 2 wherein said control means starts operation of said longitudinal sealer earlier by T2–T1 than when said discharge-end signal is outputted if T2 is longer than T1.

4. The packaging machine of claim 2 wherein said control means includes a timer for counting said delay period.

5. The packaging machine of claim 2 further comprising calculating means for subtracting said seal time period from said delay period.

6. The packaging machine of claim 2 further comprising an input device through which said seal time is transmitted to said control means.

7. A packaging machine operating in combination with a weigher, said packaging machine comprising:

film transporting means for transporting an elongated bag-making film in a longitudinal direction while bending said film into a tubular form;

a longitudinal sealer for sealing edges of said tubularly formed film in said longitudinal direction;

a transverse sealer for sealing said longitudinally sealed film in a transverse direction which is transverse to said longitudinal direction; and a control means for operating said longitudinal sealer for a specified seal time period when a ready signal is outputted from said control means to said weigher to request a discharge of articles but no discharge-end signal indicative of the discharge of articles from said weigher is received from said weigher in response to said ready signal, said control means further serving to start operations of said longitudinal sealer, said transverse sealer and said film-transporting means after a specified period of time has elapsed when said discharge-end signal is received from said weigher subsequently.

8. A packaging machine operating in combination with a weigher, said packaging machine comprising:

film transporting means for transporting an elongated bag-making film in a longitudinal direction while bending said film into a tubular form;

a longitudinal sealer for sealing edges of said tubularly formed film in said longitudinal direction;

a transverse sealer for sealing said longitudinally sealed film in a transverse direction which is transverse to said longitudinal direction; and a control means for operating said longitudinal sealer for a specified seal time period when a ready signal is initially outputted from said control means to said weigher after said packaging machine is activated to request a discharge of articles from said weigher but no discharge-end signal indicative of the discharge of articles is received from said weigher in response to said ready signal, said control means further serving to start operations of said longitudinal sealer, said transverse sealer and said film-transporting means after a specified period of time has elapsed when said discharge-end signal is received from said weigher subsequently.

* * * * *